US012247507B1

(12) United States Patent
Harajda

(10) Patent No.: US 12,247,507 B1
(45) Date of Patent: Mar. 11, 2025

(54) INJECTION GRID FOR EXHAUST DUCT

(71) Applicant: Mitsubishi Power Americas, Inc., Lake Mary, FL (US)

(72) Inventor: Daniel Harajda, Walnutport, PA (US)

(73) Assignee: Mitsubishi Power Americas, Inc., Lake Mary, FL (US)

( * ) Notice: Subject to any disclaimer, the term of this patent is extended or adjusted under 35 U.S.C. 154(b) by 0 days.

(21) Appl. No.: 18/431,072

(22) Filed: Feb. 2, 2024

(51) Int. Cl.
*F01D 25/30* (2006.01)
*F01N 3/20* (2006.01)

(52) U.S. Cl.
CPC ..... *F01N 3/206* (2013.01); *F01D 25/305* (2013.01)

(58) Field of Classification Search
CPC ... F01N 3/206; F05D 2270/082; F01D 25/305
See application file for complete search history.

(56) References Cited

U.S. PATENT DOCUMENTS 4,950,473 A * 8/1990 Flockenhaus ..... B01D 53/56 422/62
9,399,927 B2 7/2016 Mcdeed et al.
10,092,878 B2 10/2018 Zhang et al.
2013/0104519 A1 5/2013 Zhang et al.
2013/0213511 A1* 8/2013 Yukimura ..... B01F 23/451 137/897
2017/0356319 A1* 12/2017 Zhang ..... F01N 11/00
2018/0238211 A1 8/2018 Kulkarni et al.

FOREIGN PATENT DOCUMENTS

CN 115672023 A 2/2023

* cited by examiner

*Primary Examiner* — Gerald L Sung
(74) *Attorney, Agent, or Firm* — Schwegman Lundberg & Woessner, P.A.

(57) ABSTRACT

A distribution system for injecting reductant into an exhaust duct of a power plant comprises a first injection grid comprising a first manifold and a first plurality of distribution branches, and a second injection grid comprising a second manifold and a second plurality of distribution branches, wherein the first plurality of distribution branches is interleaved with the second plurality of distribution branches, and the first plurality of distribution branches and the second plurality of distribution branches each receive reductant flow from their respective manifold in opposite directions. A method for injecting a reductant into an exhaust comprises generating a first mass flow gradient of reductant along a first axis, generating a second mass flow gradient of reductant along a second axis, wherein the mass flow gradients decrease in directions along their axes, wherein the first direction and the second direction are disposed in a counterflow arrangement.

21 Claims, 9 Drawing Sheets

INJECTION GRID FOR EXHAUST DUCT

TECHNICAL FIELD

The present disclosure relates generally to thermal power plants, such as coal-fired and simple cycle and combined cycle gas turbine power plants. More particularly, the present disclosure relates to systems and methods for reducing emissions in power plants that generate emissions gas.

BACKGROUND

In a gas turbine power plant, a gas turbine engine can be operated to directly generate electricity with a generator using shaft power. Compressed air and fuel can be combusted to produce exhaust gas to rotate a turbine of the gas turbine engine. The turbine can be used to drive a compressor to produce the compressed air and an electrical generator to produce electricity.

In simple cycle operation of a gas turbine engine power plant, the exhaust gas is typically vented to atmosphere, sometimes with the use of systems for removing hazardous materials from the emissions. In other configurations, gas turbine operation can be combined with a steam system. The steam systems can be used to generate steam that drive a steam turbine, which can then be used to generate electricity. Steam systems for combined-cycle power plants can typically comprise a multi-circuit heat recovery steam generator (HRSG) operating a Rankine cycle in combination with the gas turbine Brayton cycle. Working fluid for a gas turbine combined cycle (GTCC) power plant typically comprises air and/or gas (topping cycle) and steam and/or water (bottoming cycle), with a gas or liquid fuel burned in the gas turbine engine.

In order to comply with environmental regulations and other considerations, power plants can incorporate various emissions control systems to treat the exhaust gas for pollutants. Gas turbine emissions can be typically controlled by two systems that interact with exhaust gas of a gas turbine system. First, the exhaust gas can be passed through a catalyst system to oxidize CO from the exhaust gas into carbon dioxide (CO2), as well as oxidizing volatile organic compounds (VOCs). Second, a selective catalytic reduction (SCR) system can convert oxides of nitrogen (NOx) in the exhaust gas to nitrogen and water by a catalytic reaction of a mixture of the exhaust gas and a reducing agent or reductant, such as anhydrous ammonia, aqueous ammonia or urea. The exhaust gas and reductant mixture can react in presence of a catalyst disposed in a panel or bed positioned in the flow path of the exhaust gas. SCR system reactors are typically placed downstream of an exhaust duct of a combustion source, such as a gas turbine or a coal boiler, and utilize the catalyst and the reductant to convert NOx into diatomic nitrogen (N2) and water (H2O).

Efficiency of combustion power sources, such as gas turbine engines and coal burners, can be directly related to combustion temperature. However, production of certain pollutants, such as nitrogen oxides (NOx), is also directly related to combustion temperature. As such, there is typically a conflict between optimizing combustion efficiency and the production or reduction of pollutants.

Examples of emission control systems in gas turbine systems are described in U.S. Pat. No. 9,399,927 to McDeed et al.; U.S. Pub. No. 2018/0238211 to Kulkarni et al.; and U.S. Pub. No. 2013/0104519 to Zhang et al.

Overview

The present inventor has recognized, among other things, that a problem to be solved can include the inefficient distribution of a reducing agent (reductant), such as ammonia, within an exhaust duct. It can be desirable for the reducing agent to interact with all or most portions of the exhaust gas within the exhaust duct in an equal or nearly equal manner to be able to enable the reaction process and reduce the most emissions. However, it can be difficult to control distribution of the reducing agent within the exhaust duct using conventional distribution injection or distribution systems. For example, many distribution systems involve the injection of the reducing agent from a manifold connected to a plurality of distribution branches. The distribution branches can extend from the manifold into the cross-sectional area of the exhaust duct and can include a plurality of outlet orifices to release the reducing agent into the exhaust gas. However, as the reducing agent travels from the manifold through each distribution branch, the properties of the reducing agent can change. Specifically, flow resistance may create a pressure gradient within the distribution branch. Further, the reducing agent increases in temperature within the distribution branches the further it must travel to reach an outlet orifice. As such there is a temperature gradient of the reducing agent across the distribution branches. This temperature gradient produces a corresponding density gradient in the reducing agent, which, along with the pressure gradient can result in uneven distribution of reducing agent mass along the length of the distribution branch, and thus, within the exhaust duct.

The present subject matter can help provide a solution to this problem and other problems, such as by providing a distribution system that distributes a gas or liquid, such as a reducing agent for an emissions reduction system, in an even manner, e.g., with an even distribution pattern of reagent within an exhaust duct. In particular, the present disclosure relates to the use of multiple manifolds that can utilize interleaved distribution branches having counterflow of reducing agent. As such, a gradient in mass flow of reducing agent from one manifold can be offset or counterbalanced by a gradient in mass flow in another manifold.

In an example, a distribution system for injecting reductant into an exhaust duct of a thermal power plant can comprise a first injection grid comprising a first manifold and a first plurality of distribution branches extending from the first manifold, and a second injection grid comprising a second manifold and a second plurality of distribution branches extending from the second manifold, wherein the first plurality of distribution branches is interleaved with the second plurality of distribution branches, and the first plurality of distribution branches and the second plurality of distribution branches each receive reductant flow from their respective manifold in opposite directions.

In another example, an emissions reduction system for a power plant having an exhaust generator comprises a duct defining a flow space configured to receive exhaust gas from the exhaust generator, a catalyst panel disposed within the duct and an injection system configured to inject a reductant into the exhaust gas for reaction with NOx in presence of the catalyst panel. The injection system can comprise a first injection grid configured to inject reductant into the duct along a first axis having a first reductant mass flow gradient and a second injection grid configured to inject reductant into the duct along a second axis having a second having a second reductant mass flow gradient, wherein the first reductant mass flow gradient and the second reductant mass flow gradient have offsetting trajectories within the duct.

In an additional example, a method for injecting a reductant into an exhaust duct of a power plant can comprise generating a first mass flow gradient of reductant along a first axis, wherein the first mass flow gradient decreases in a first direction along the first axis, generating a second mass flow gradient of reductant along a second axis, wherein the second mass flow gradient decreases in a second direction along the second axis, wherein the first direction and the second direction are disposed in a counterflow arrangement, releasing reductant of the first mass flow gradient into the exhaust duct, and releasing reductant of the second mass flow gradient into the exhaust duct.

This overview is intended to provide an overview of subject matter of the present patent application. It is not intended to provide an exclusive or exhaustive explanation of the invention. The detailed description is included to provide further information about the present patent application.

Figure 1:
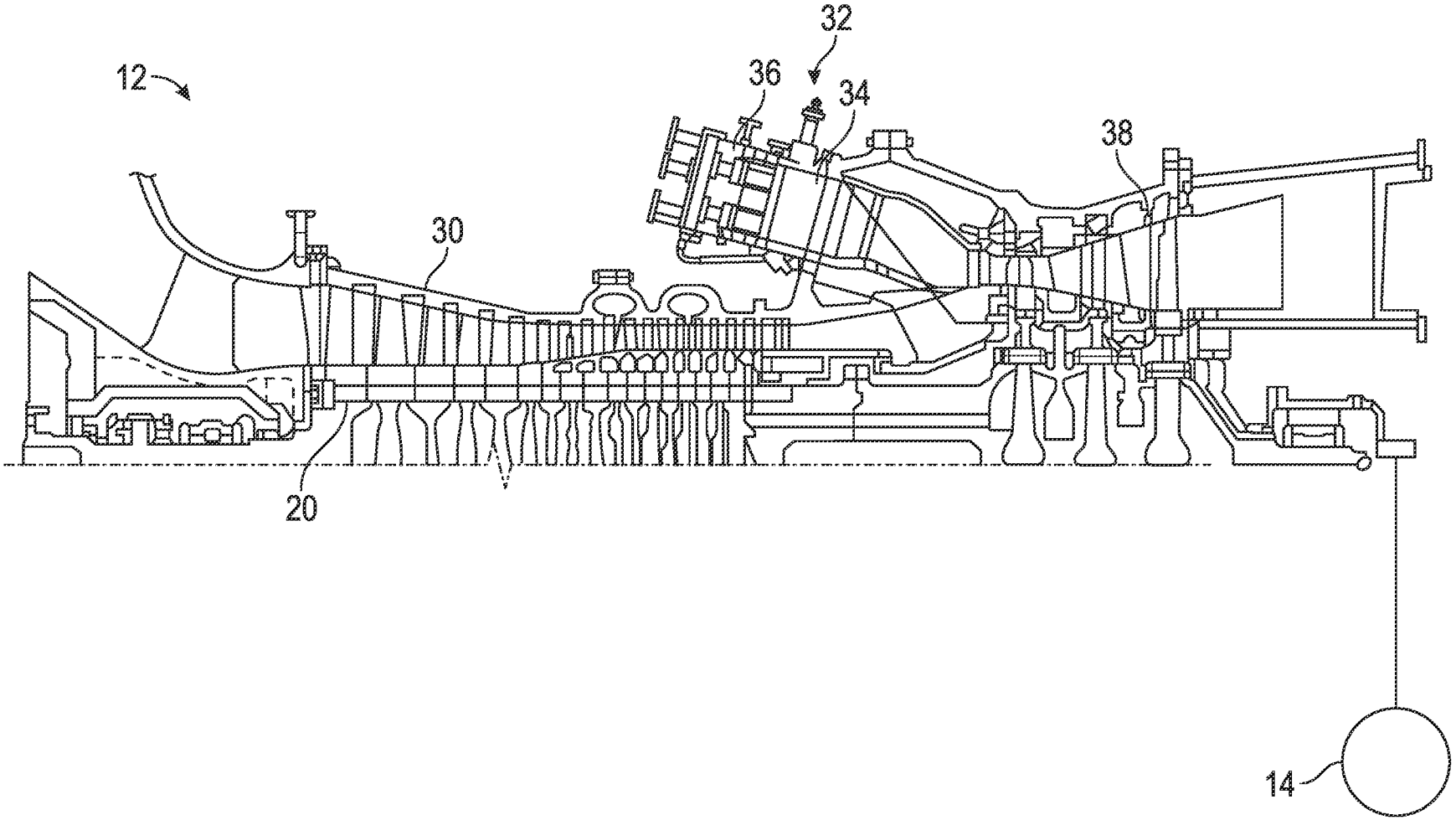
FIG. 1 (Prior Art)
FIG. 1 is a cross-sectional view of a conventional gas turbine system.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

FIG. 1 is a cross-sectional view of an embodiment of gas turbine system 12. Gas turbine system 12 can comprise compressor 30 and combustor 32. Combustor 32 can include combustion region 34 and fuel nozzle assembly 36. Gas turbine system 12 can also include gas turbine 38, which can be coupled to compressor 30 via common shaft 20. In operation, air can enter the inlet of compressor 30, can be compressed and then discharged to combustor 32 where fuel, such as a gas, e.g., natural gas, or a fluid, e.g., oil, injected from fuel nozzle assembly 36 is burned to provide high energy combustion gases that can drive gas turbine 38. In gas turbine 38, the energy of the hot gases is converted into work at common shaft 20. Common shaft 20 can be used to drive compressor 30 and other loads such as generator 14 to produce electricity.

The energy in the exhaust gases exiting gas turbine system 12 can be exhausted to atmosphere, such as through an exhaust duct and a stack, or can be converted into additional useful work, such as in a heat recovery steam generator (HRSG), before being exhausted to atmosphere. In additional examples, exhaust gas can be generated by other types of combustion processes, including coal plants and the like.

Governmental agencies have required power plants to meet environmental emissions limits. For example, environmental emissions limits can set maximum emissions for nitrogen dioxide (NOx) and carbon monoxide (CO) during various operating conditions of the power plant, such as at start-up and full capacity. As such, power plants can include various forms of emissions reductions systems. For example, the exhaust gas may be passed through a CO catalyst system within an exhaust duct to oxidize CO to CO2, and may also oxidize VOCs. Further, a selective catalytic reduction (SCR) system within the exhaust duct or HRSG can convert NOx to nitrogen and water by causing a mixture of a reducing agent, e.g., anhydrous ammonia, aqueous ammonia or urea and the exhaust to react in presence of a catalyst that facilitates the reaction. Examples of SCR systems are discussed in greater detail with reference to FIG. 2.

Figure 2:
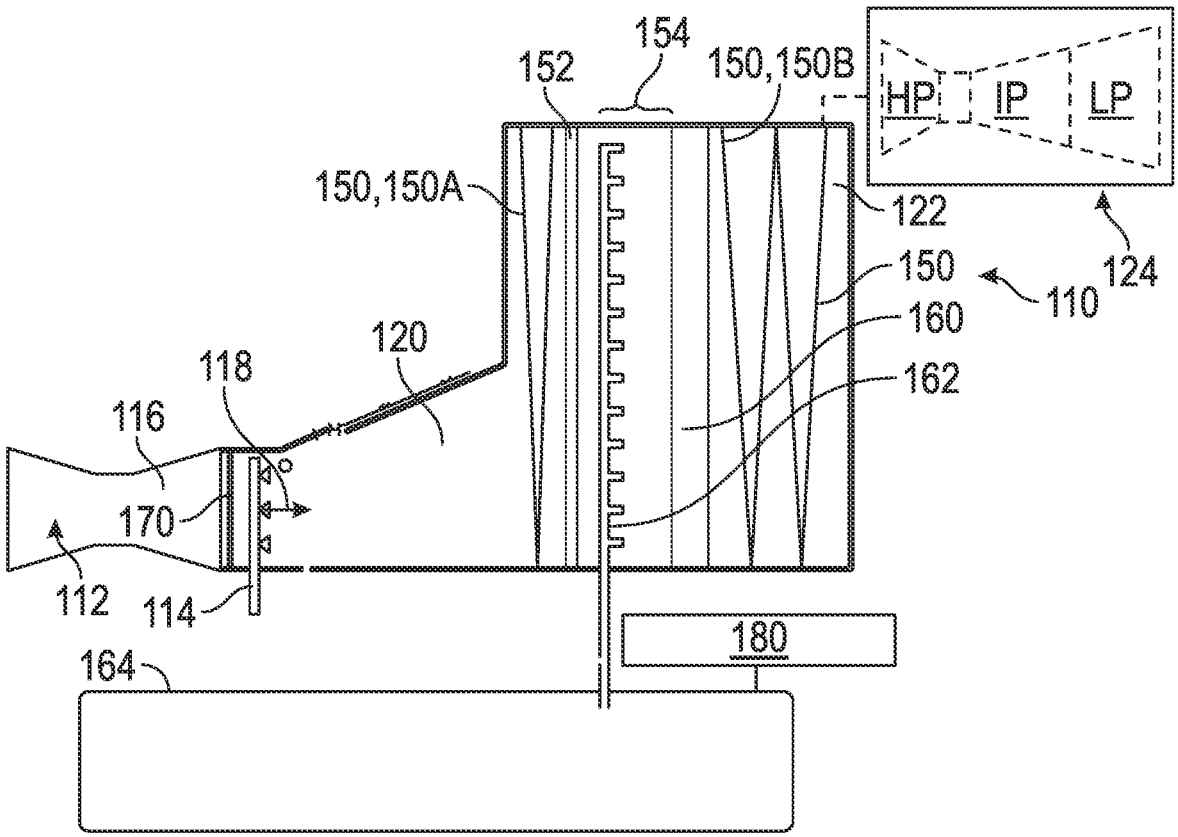
FIG. 2 is a cross-sectional view of a power plant including an emission reduction system incorporated into an exhaust duct.

FIG. 2 is a cross-sectional view of power plant 110 including gas turbine system 112 operatively coupled to exhaust duct 122. Gas turbine system 112 can include one or more of any conventional combustion-based gas turbine engines, such as the one shown in FIG. 1. Gas turbine system 112 may include a conventional duct burner 114 downstream of gas turbine 116, which can burn additional fuel to raise the temperature of exhaust gas 118 exiting gas turbine 116. Exhaust gas 118 can include a variety of combustion byproducts such as carbon dioxide, carbon monoxide (CO), nitrogen oxide (NOx), Volatile Organic Compounds (VOCs) and the like. Exhaust gas 118 can pass through exhaust passage 120 operatively coupled to gas turbine 116 and exhaust duct 122. Exhaust passage 120 can be configured to direct exhaust gas 118 downstream of gas turbine 116, such as to exhaust duct 122. Exhaust passage 120 can be an integral part of exhaust duct 122, or can be a separate passage upstream but operatively coupled to exhaust duct 122. Exhaust passage 120 defines a portion of an exhaust path that continues into exhaust duct 122 through which exhaust gas 118 passes.

In examples, power plant 110 can comprise a simple cycle power plant where exhaust gas of gas turbine system 112 is vented to atmosphere after passing through exhaust duct 122. In examples, exhaust duct 122 can be operably coupled to exhaust passage 120 of gas turbine 116 for generating steam for steam turbine 124, which is shown schematically in phantom in FIG. 2. In such configurations, exhaust duct 122 can include a steam generating heat exchanger and can include heat exchange pipes 150 through which water and/or steam can be passed to increase the temperature and energy level of the water and/or steam. For example, exhaust duct 122 can include heat exchange pipes 150 that can function as conventional parts of a HRSG such as but not limited to: superheater(s), economizer(s) and reheat section(s) for any number of steam turbine stages (i.e., HP, IP and/or LP). Any conventional steam or boiler drums (not shown) can also be provided as part of a HRSG in conjunction with exhaust duct 122 to be fluidly connected to the steam system. A HRSG can also include various piping or valving (not shown) to deliver water/steam, as desired. However, when exhaust duct 122 is configured for simple cycle operation, heat exchange pipes 150 can be omitted.

Figure 3A:
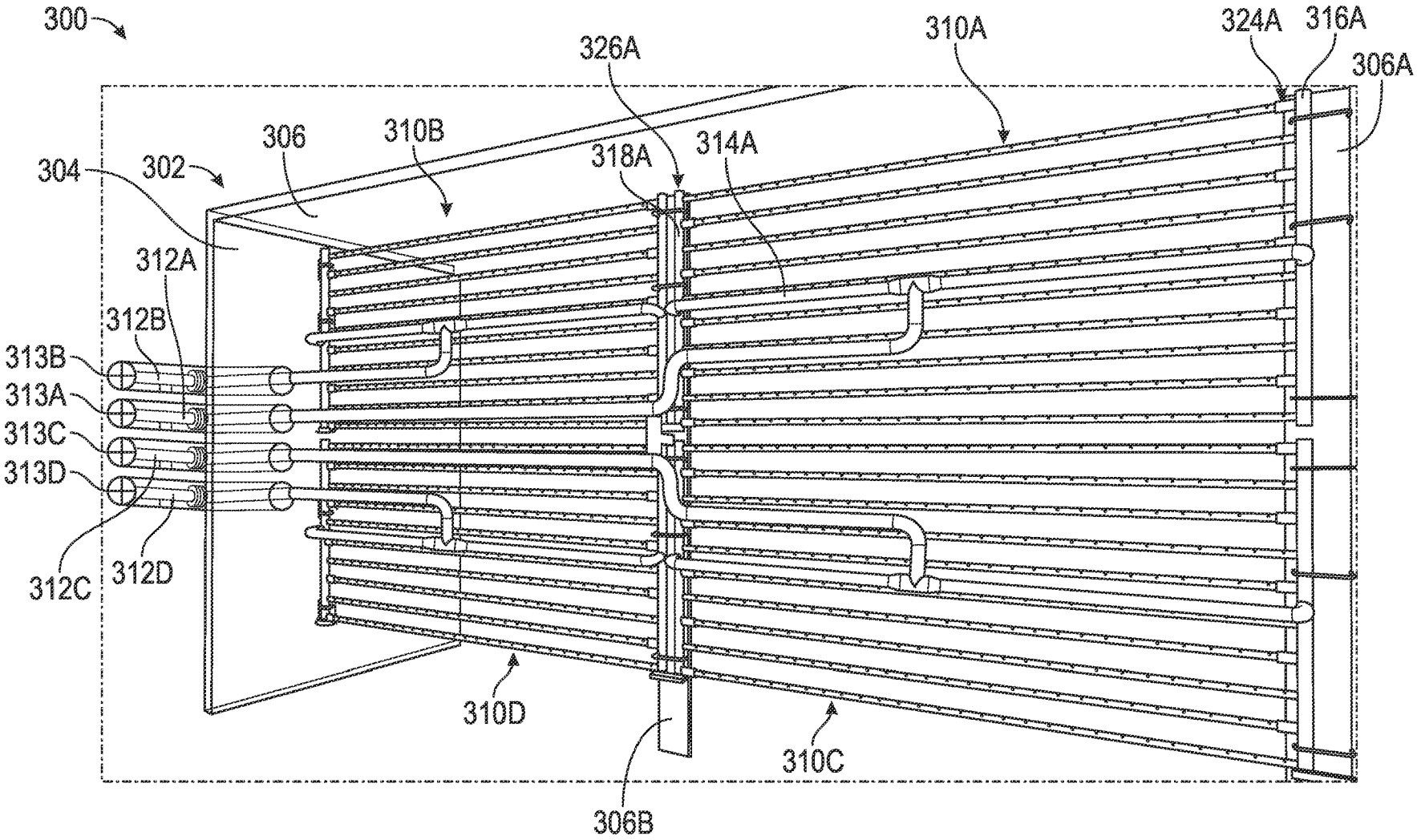
FIG. 3A is a perspective view of an injection system for an emission reduction system of the present disclosure showing four distribution grids.

Exhaust duct 122 can also include a conventional carbon monoxide (CO) catalyst 152 downstream of a first set of heat exchange pipes 150A. Catalyst 152 can include a CO catalytic material capable of carrying out the desired catalytic conversion of CO to carbon dioxide (CO2) or other less toxic pollutants in a conventional manner. Exhaust duct 122 can also include a selective catalytic reduction system (SCR), e.g., SCR system 154, which can be located upstream of a second set of heat exchange pipes 150B. SCR system 154 can include SCR catalyst 160 and an SCR reducing agent injector 162. SCR system 154 can convert NOx to nitrogen and water by causing a mixture of the exhaust gas and a reducing agent, as provided by reducing agent injector 162, to react in presence of SCR catalyst 160. Reducing agent injector 162 can inject a reducing agent such as anhydrous ammonia, aqueous ammonia or urea, and SCR catalyst 160 can comprise a panel formed of or that can include a porous catalyst material, such as a metal oxide or zeolite based porous catalyst. Reducing agent injector 162 can comprise an ammonia injection grid (AIG), as shown in FIG. 3A.

In examples, SCR catalyst 160 can take the form of combined SCR/CO catalyst. In such a configuration, SCR catalyst 160 can include both SCR layers and CO catalyst layers, and is functional to remove both NOx and CO.

SCR reducing agent injector 162 can be coupled to any form of reductant delivery system 164 for delivery of a reducing agent, such as to entrain the reducing agent within a flow of air, such as exhaust gas 118 for example. Reductant delivery system 164 can comprise appropriate tanks, pumps, pipes, valves and the like to deliver reductant to SCR reducing agent injector 162. Controller 180 can be employed to control the afore-described components. Controller 180 can be configured, e.g., via hardware and/or software modifications, to control various operational functions of reductant delivery system 164 which deliver reducing agent to SCR reducing agent injector 162.

SCR catalyst 160 can span, or substantially span, the width and height of exhaust duct 122. SCR reducing agent injector 162 can comprise an injector system such as an array of nozzles, sprayers, etc., capable of mixing the reducing agent with exhaust gas 118 and supplying such mixture to SCR catalyst 160. SCR reducing agent injector 162 can be configured to introduce, e.g., inject, reductant, across the width and height of exhaust duct 122. In examples, SCR reducing agent injector 162 can be permanently mounted within exhaust duct 122, or can be configured as an add-on system. SCR reducing agent injector 162 can include metal piping and nozzles capable of withstanding the temperatures and load placed on it by exhaust gas 118 of gas turbine 116. As described in greater detail with reference to FIG. 3A through FIG. 8, reducing agent injector 162 can be configured to introduce reducing agent into exhaust duct 122 in uniform or nearly uniform distribution across the width and height of exhaust duct 122 to facilitate effective treatment of all exhaust gas 118 flowing through exhaust duct 122 via exhaust passage 120. For the avoidance of doubt, as used herein, the term "exhaust duct" shall mean any structure into which a catalyst 152 or SCR system 154 may be disposed, such that the exhaust duct shall force the flow of exhaust gases through the catalyst 152 and/or SCR system 154. Although depicted in FIG. 2 as part of a HRSG structure, the scope of the disclosure is not so limited, and exemplary exhaust ducts into which a catalyst 152 or SCR system 154 may be disposed may be part of a thermal power plant, such as simple cycle gas turbine power plant or coal power plant, for example.

In operation, the reducing agent is injected onto SCR catalyst 160 via SCR reducing agent injector 162. Thus, exhaust gas 118 passes through SCR reducing agent injector 162 mixing with reductant and then continues through the SCR catalyst 160. As the mixture of exhaust gas 118 and reductant pass through SCR catalyst 160, the NOx and the reductant within the mixture react in presence of the SCR catalyst 160, which, via catalytic reduction, reduces NOx to nitrogen and water, which then may be exhausted to atmosphere.

Exhaust duct 122 can also include flow distributor 170 upstream of duct burner 114 to distribute the exhaust gas flow within exhaust passage 120 in case the profile of mass and/or velocity of the exhaust gas 118 is not uniform, such as can arise during certain operating conditions of gas turbine 116, e.g., during start-up. Flow distributor 170 can include a perforated plate or some other design to distribute the flow properly, e.g., uniformly. Likewise, another flow distributor similar to flow distributor 170 but larger in area, can be placed upstream of catalyst 152 or SCR system 154 to distribute exhaust gas within exhaust duct 122 upstream of SCR reducing agent injector 162. In examples of the present disclosure, the interleaved distribution branches of the present disclosure can be used in other portions of power plant 110, such as duct burner 114 to inject fuel to enhance uniform combustion thereof within exhaust passage 120. In additional examples, the interleaved distribution branches of the present disclosure can be used to inject steam or water into an evaporative cooler.

Previous attempts at reducing emissions using SCR systems have involved the placement of a reductant distribution system within the exhaust stream. The reductant is injected into the exhaust stream from a plurality of distribution branches or injection lances that are each connected to a common supply manifold. The distribution branches are typically oriented at approximately ninety degrees to the supply manifold and run an entire width (or height) of the exhaust duct into which the SCR catalyst is disposed. Each distribution branch can be fed at one end by the supply manifold and can have a closed opposite end. The distribution branches have a plurality of openings or orifices from which the reductant is injected into the exhaust stream. As a result of reductant flowing within the distribution branch, along a trajectory across the exhaust duct from the manifold through the distribution branch, a temperature gradient of the reductant can be created. For example, the reducing agent dispensed through an orifice at the end of the distribution branch opposite the manifold is exposed to the heat of the exhaust gas for a longer time than reducing agent dispensed through an orifice at the end of the distribution branch nearest to the manifold. The temperature gradient can result in a density gradient along the trajectory that affects the amount of reductant delivered along the length of the distribution branch, to each end thereof. Further, flow resistance within the distribution branch may create a pressure gradient within the distribution branch. It will be recognized that the superposition of the pressure gradient and the temperature/density gradient will result in a distribution gradient or mass flow gradient of reductant from each of the openings along the length of the distribution branch. For example, the lower temperature reductant near the manifold will be denser than the higher temperature reductant at the distal end of the distribution branch, resulting in less reductant being delivered through the orifice or nozzle at the distal end of the distribution branch. Such conditions can also arise where a manifold is positioned at the center or in a central portion of the distribution branches. In such scenarios, two distribution gradients flow outward from the manifold to the two ends of the distribution branches. In either case, an uneven distribution of the reductant will be delivered to the cross-sectional area of the exhaust duct, thereby resulting in different portions of the exhaust gas receiving different amounts of reductant with which to mix. Thus, some of the exhaust gas can be untreated or only partially treated, or excess reducing agent dispensed in order to ensure that all exhaust gas is treated. The reducing agent flow distribution within the distribution branches can be further worsened if the temperature gradient within the SCR system 154 is uneven, thereby further impacting the density of the reducing agent in the distribution grids.

As discussed herein, the present disclosure can take advantage of the distribution or mass flow gradients by locating two sets of distribution branches, which receive reductant at opposite ends, proximate each other, thereby superposing the mass flows of the orifices, resulting in significantly improved reductant distribution across the width of an exhaust duct, which in some cases can be nearly equal or equal at least from a theoretical standpoint. However, variations may arise due to thermodynamics and mechanical variations in the system. For example, a first manifold can be located on the left side of an exhaust duct and a second manifold can be located on the right side of the exhaust duct. A first distribution branch can extend from the left manifold across the exhaust duct to close proximity of the right manifold without fluidly connecting to the right manifold. A second distribution branch can extend from the right manifold across the exhaust duct to close proximity of the left manifold without fluidly connecting to the left manifold. Thus, an injection orifice for the first distribution branch having a "maximum" reductant flow proximate the first manifold will be paired with an injection orifice for the second distribution branch having a "minimum" reductant flow proximate the first manifold. Likewise, an injection orifice for the second distribution branch having a "maximum" reductant flow proximate the second manifold will be paired with an injection orifice for the first distribution branch having a "minimum" reductant flow proximate the second manifold. Superposition of such orifices results in approximately equivalent reductant flows along the length of such adjacent distribution branches within the exhaust duct.

FIG. 3A is a perspective view of injection system 300 according to the present disclosure that can be used in exhaust duct 302 of a power plant. In examples, injection system 300 can comprise reducing agent injector 162 of FIG. 2 and exhaust duct 302 can comprise exhaust duct 122 of FIG. 2.

Exhaust duct 302 can comprise sidewall 304 and ceiling 306. Exhaust duct 302 can additionally include a floor and another sidewall that opposes sidewall 304 to form a four-sided duct. However, such components are omitted from FIG. 3A for illustrative purposes. Exhaust duct 302 can further include first support column 306A and second support column 306B.

Injection system 300 comprises first injection grid 310A, second injection grid 310B, third injection grid 310C and fourth injection grid 310D. First injection grid 310A can be connected to first supply pipe 312A, second injection grid 310B can be connected to second supply pipe 312B, third injection grid 310C can be connected to third supply pipe 312C and fourth injection grid 310D can be connected to fourth supply pipe 312D. First supply pipe 312A, second supply pipe 312B, third supply pipe 312C and fourth supply pipe 312D can be connected to control valve 313A, control valve 313B, control valve 313C and control valve 313D, respectively.

First injection grid 310A, second injection grid 310B, third injection grid 310C and fourth injection grid 310D can be arranged in a two-by-two relationship to cover the cross-sectional area of exhaust duct 302. Each of first injection grid 310A, second injection grid 310B, third injection grid 310C and fourth injection grid 310D can have a rectangular shape that can be pieced together to form a larger rectangular area that has the cross-sectional shape of exhaust duct 122. However, in other examples each of first injection grid 310A, second injection grid 310B, third injection grid 310C and fourth injection grid 310D can have different rectangular shapes, square shapes or other shapes. In the illustrated example, first injection grid 310A, second injection grid 310B, third injection grid 310C and fourth injection grid 310D can have widths that are wider than their height. However, in other examples, first injection grid 310A, second injection grid 310B, third injection grid 310C and fourth injection grid 310D can have heights greater than the widths. In the illustrated example, first injection grid 310A, second injection grid 310B, third injection grid 310C and fourth injection grid 310D can be configured to flow reductant through their respective distribution branches in a side-to-side or horizontal manner. However, in other examples, first injection grid 310A, second injection grid 310B, third injection grid 310C and fourth injection grid 310D can be configured to flow reductant in their respective distribution branches in an up-and-down or vertical manner.

Each of first injection grid 310A, second injection grid 310B, third injection grid 310C and fourth injection grid 310D can be configured to deliver reductant to a portion of the cross-sectional area of exhaust duct 302 in a uniform or nearly uniform manner. In particular, each of first injection grid 310A, second injection grid 310B, third injection grid 310C and fourth injection grid 310D can be more uniform than prior art systems. Uniformity can be achieved by having counterflows of reductant extending within the footprint of each grid. Specifically, reductant can bi-directionally flow from each outer edge of each grid to the opposite outer edge, as explained in greater detail below. Thus, mass flow rates of reductant at each axial (for the illustrated embodiment) or vertical position along the grid can have the same net reductant flow.

Figure 3B:
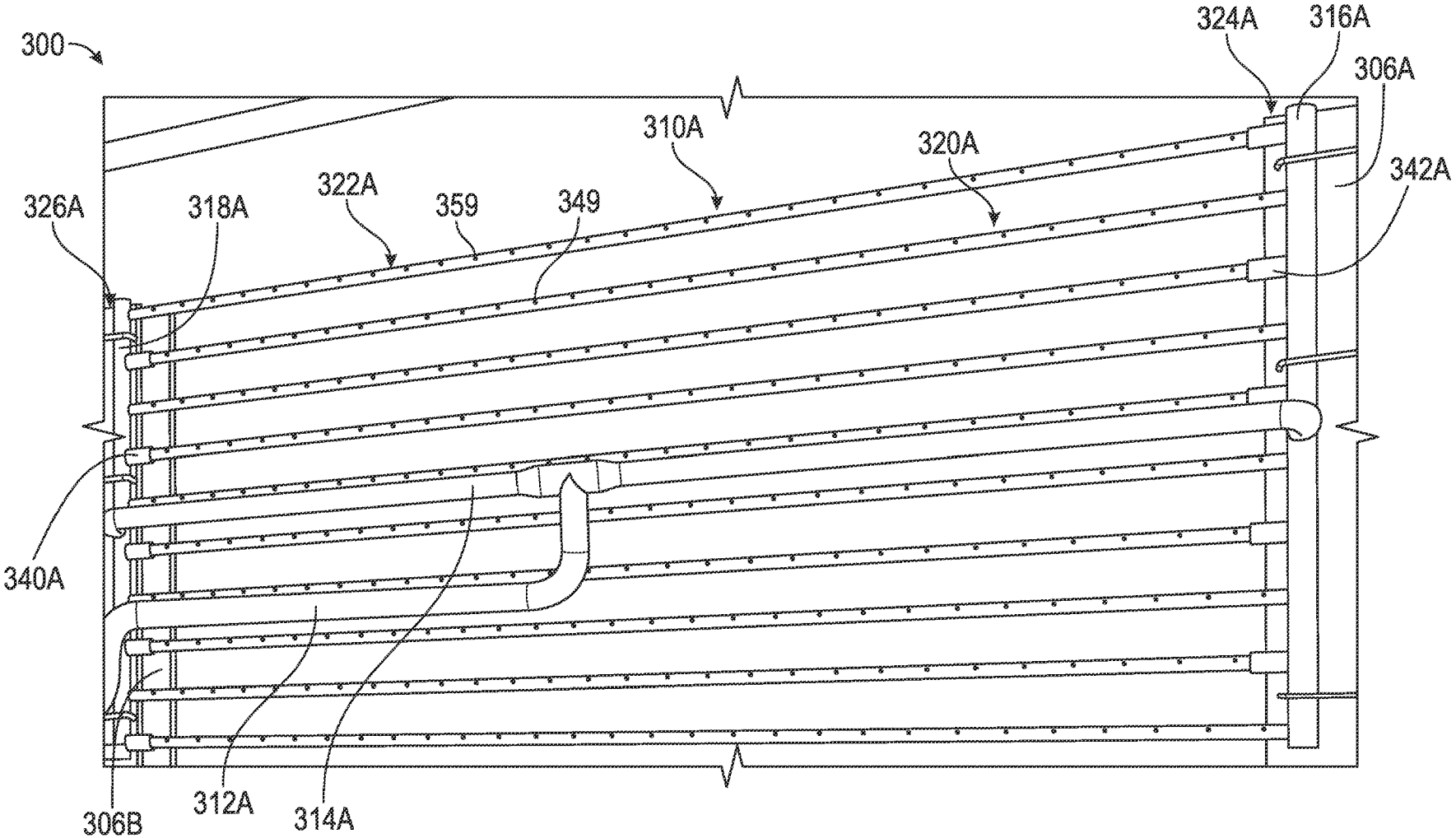
FIG. 3B is a close-up perspective view of one of the distribution grids of the injection system of FIG. 3A.

FIG. 3B is a close-up perspective view of one of the distribution grids of the injection system of FIG. 3A. First injection grid 310A can comprise header 314A, which can be connected to first manifold 316A and second manifold 318A. First manifold 316A can be connected to first distribution branches 320A and second manifold 318A can be connected to second distribution branches 322A. First manifold 316A and first distribution branches 320A can collectively be referred to as first section 324A of first injection grid 310A, and second manifold 318A and second distribution branches 322A can collectively be referred to as second section 326A of first injection grid 310A. As discussed herein, first distribution branches 320A can be interleaved with second distribution branches 322A in a counterflow relationship to provide reductant evenly across exhaust duct 302.

First injection grid 310A, second injection grid 310B, third injection grid 310C and fourth injection grid 310D (FIG. 3A) can be configured similarly to each other and have the same or similar components. Thus, second injection grid 310B, third injection grid 310C and fourth injection grid 310D can have the same or similar elements as the enumerated elements of first injection grid 310A, but reference numbers are omitted for clarity.

Reductant can flow into first supply pipe 312A to enter into header 314A. Reductant can flow to the ends of header 314A to reach first manifold 316A and second manifold 318A. From first manifold 316A, the reductant can flow into each of first distribution branches 320A. From second manifold 318A, the reductant can flow into each of second distribution branches 322A. Reductant from first distribution branches 320A can flow into exhaust duct 302 via plurality of openings 349. Reductant from second distribution branches 322A can flow into exhaust duct 302 via plurality of openings 359.

Figure 4:
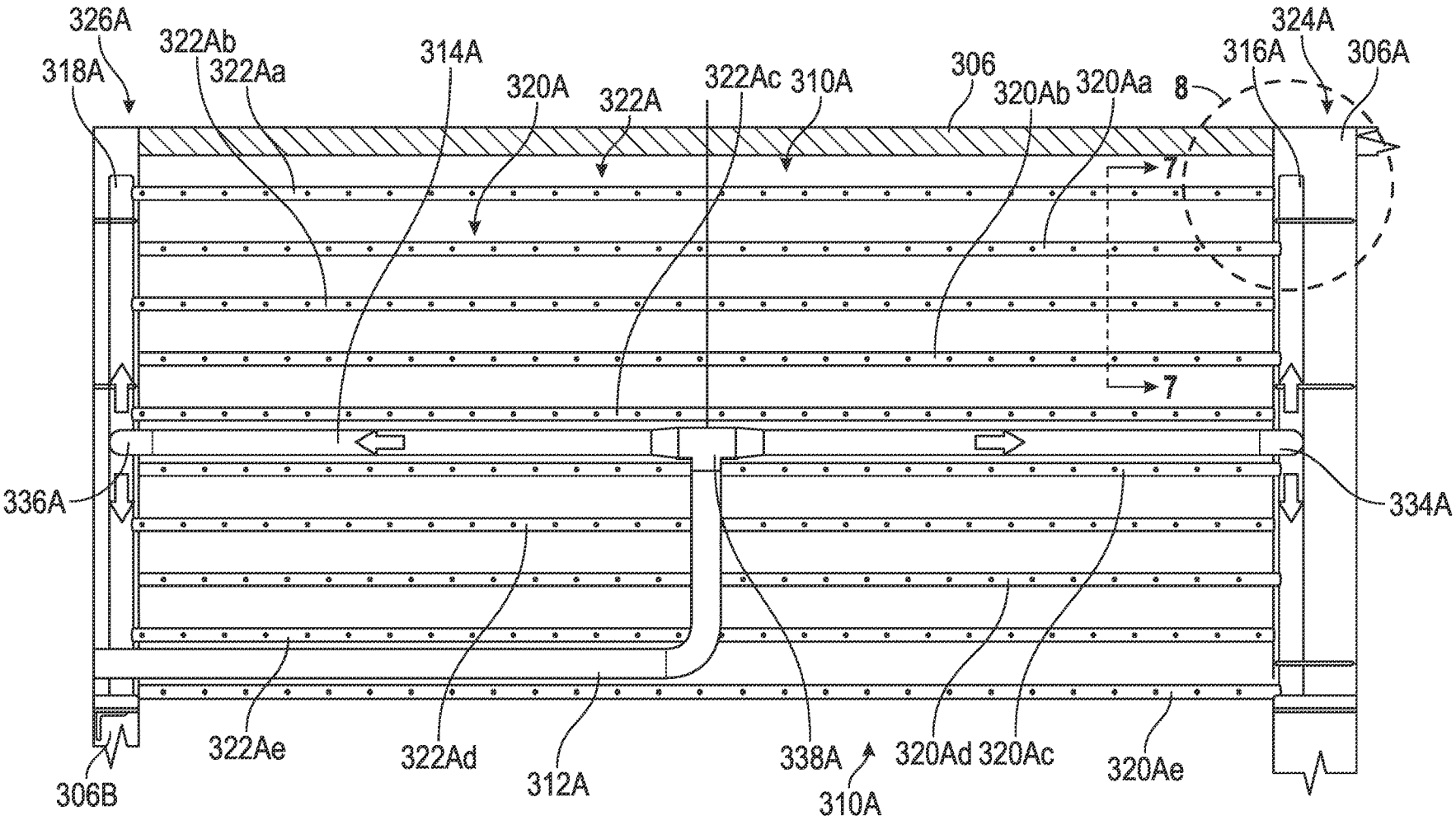
FIG. 4 is a front-end view of the injection grid of FIG. 3B showing interleaving of distribution branches of two manifolds.
Figure 5:
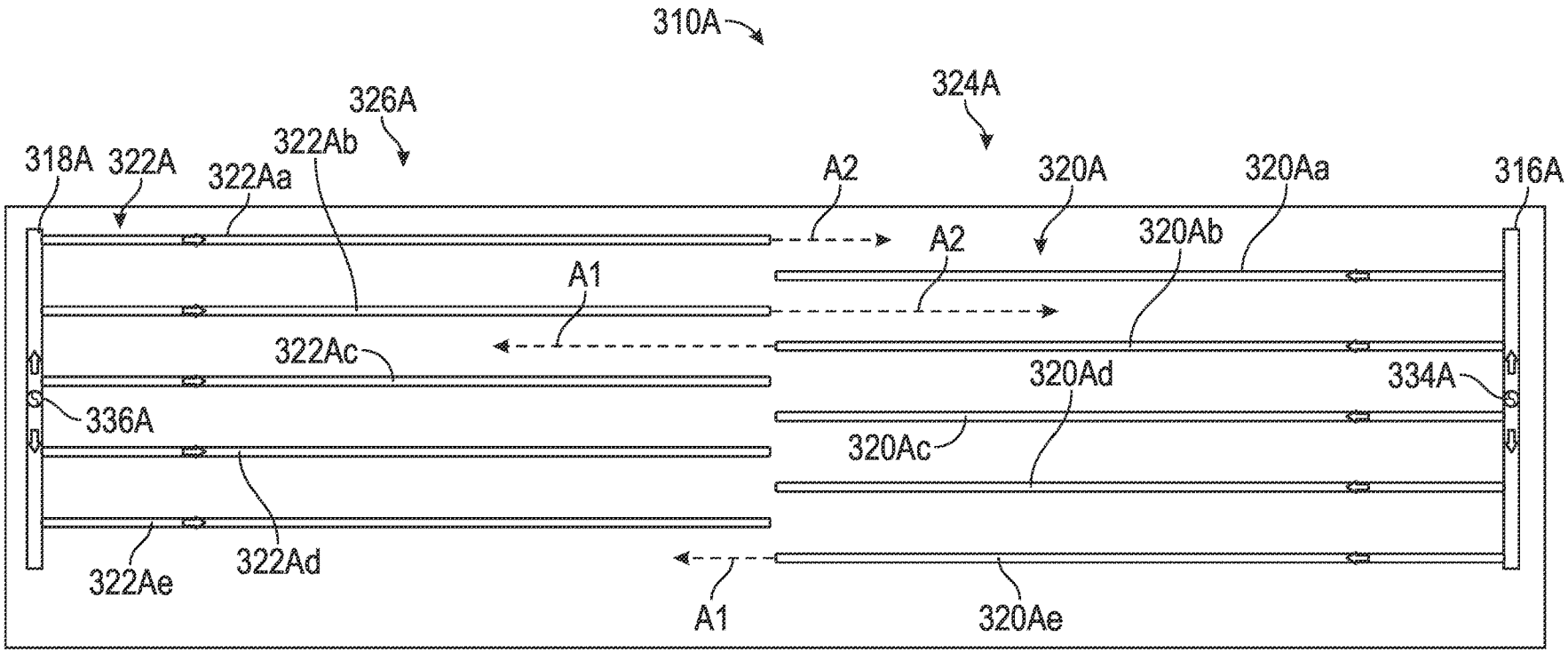
FIG. 5 is an exploded view of the distribution grid of FIG. 4 showing an alternating arrangement of the distribution branches.

FIG. 4 is a front-end view of first injection grid 310A of injection system 300 of FIG. 3B showing first distribution branches 320A of first section 324A interleaved with second distribution branches 322A of second section 326A. FIG. 5 is an exploded view of first injection grid 310A of FIG. 4 showing first section 324A and second section 326A pulled away from each other such that first distribution branches 320A and second distribution branches 322A are not interleaved. FIG. 5 is for illustrative purposes. FIG. 4 and FIG. 5 are discussed concurrently.

Header 314A can be connected to first manifold 316A and second manifold 318A via elbow connector 334A and elbow connector 336A, respectively. Header 314A can be connected to first supply pipe 312A (FIG. 3A) by T-joint 338A.

First distribution branches 320A can comprise first distribution branch 320Aa, first distribution branch 320Ab, first distribution branch 320Ac, first distribution branch 320Ad and first distribution branch 320Ae.

Second distribution branches 322A can comprise second distribution branch 322Aa, second distribution branch 322Ab, second distribution branch 322Ac, second distribution branch 322Ad and second distribution branch 322Ae.

Though first distribution branches 320A and second distribution branches are illustrated as having five distribution branches each, other numbers can be used.

First manifold 316A and second manifold 318A can be located proximate the ends of first distribution branches 320A and second distribution branches 322A. However, first manifold 316A and second manifold 318A are only connected to every other interleaved adjacent distribution branch of first distribution branches 320A and second distribution branches 322A as counted from top to bottom, for example, of first distribution grid 310A. Specifically, first manifold 316A can be connected to first distribution branches 320A and second manifold 318A can be connected to second distribution branches 322A. First distribution branches 320A can thus have a connected end in fluid communication with first manifold 316A and a free end that is closed, i.e., not in fluid communication with second manifold 318A. Conversely, second distribution branches 322A can have a connected end in fluid communication with second manifold 318A and a free end that is closed, i.e., not in fluid communication with first manifold 316A. Therefore, with reference to the orientation of FIG. 4 and FIG. 5, reductant will flow to the left from the right supply manifold (first manifold 316A) to the closed end of the first distribution branches 320A proximate the left supply manifold (second manifold 318A), and reductant will flow to the right from the left supply manifold (second manifold 318A) to the closed end of the second distribution branches 322A proximate the right supply manifold (first manifold 316A). Thus, as a result of the superposition of the distribution gradients of the first and second distribution branches 320A, 322A, localized reductant flow within exhaust duct 302 at each end of first distribution branches 320A and second distribution branches 322A can be nearly equal. In examples, first distribution branches 320A can be mechanically supported by second manifold 318A to provide structural support, such as via the use of couplers 340A. Likewise, in examples, second distribution branches 322A can be mechanically supported by first manifold 316A to provide structural support, such as via the use of couplers 342A. Couplers 340A and couplers 342A can comprise rigid connections or floating connections to accommodate thermal expansion and contraction. In examples, couplers 340A and couplers 342A can be omitted and distribution branches 320A and distribution branches 322A can be cantilevered or supported in other manners.

T-joint 338A can comprise a bifurcation of the flow of reductant to first manifold 316A and second manifold 318A. T-joint 338A can be positioned at or near the center of header 314A such that the time to flow to first manifold 316A and second manifold 318A from T-joint 338A can be equal or nearly equal. Elbow connector 334A can be positioned at or near the center of first manifold 316A such that the time to flow to the upper and lower ends of first manifold 316A can be equal or nearly equal. Elbow connector 336A can be positioned at or near the center of second manifold 318A such that the flow to the upper and lower ends of first manifold 316A can be equal or nearly equal. The lengths of first distribution branches 320A and second distribution branches 322A can be equal or nearly equal such that the time it takes to flow across each of first distribution branches 320A and second distribution branches 322A from first manifold 316A and second manifold 318A, respectively, can be equal. Thus, the flow of reductant from T-joint 338A to first manifold 316A and second manifold 318A, and then to the ends of first distribution branches 320A and the ends of second distribution branches 322A can be equal or nearly equal. Thus, the residency time for reductant within first section 324A and second section 326A of first injection grid 310A can be the equal or nearly equal, but can have inverted or mirrored temperature gradients, pressure gradients, and resultant mass flow gradients.

Figure 7:
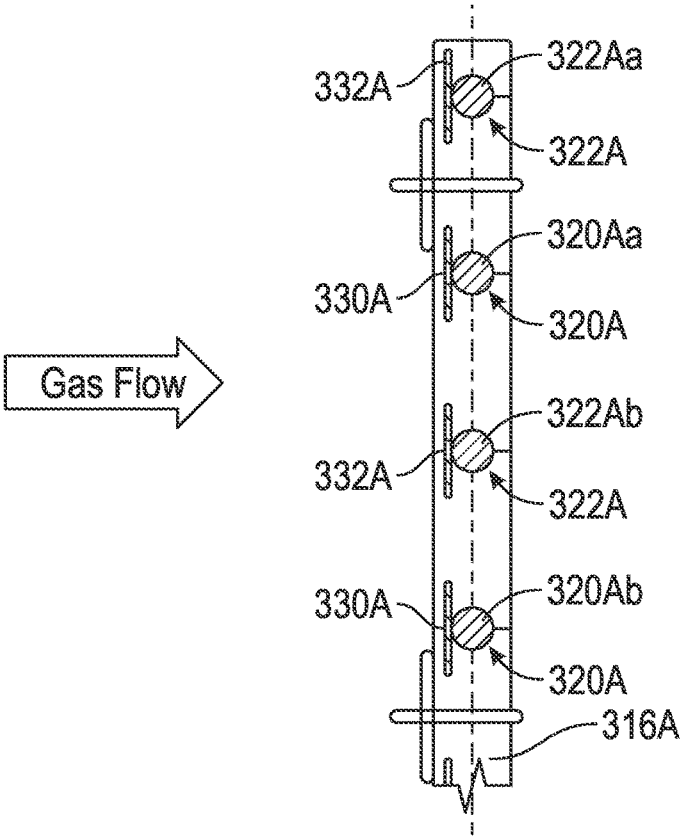
FIG. 7 is schematic side cross-sectional view of distribution branches and a manifold located relative to mixing baffles.
Figure 8:
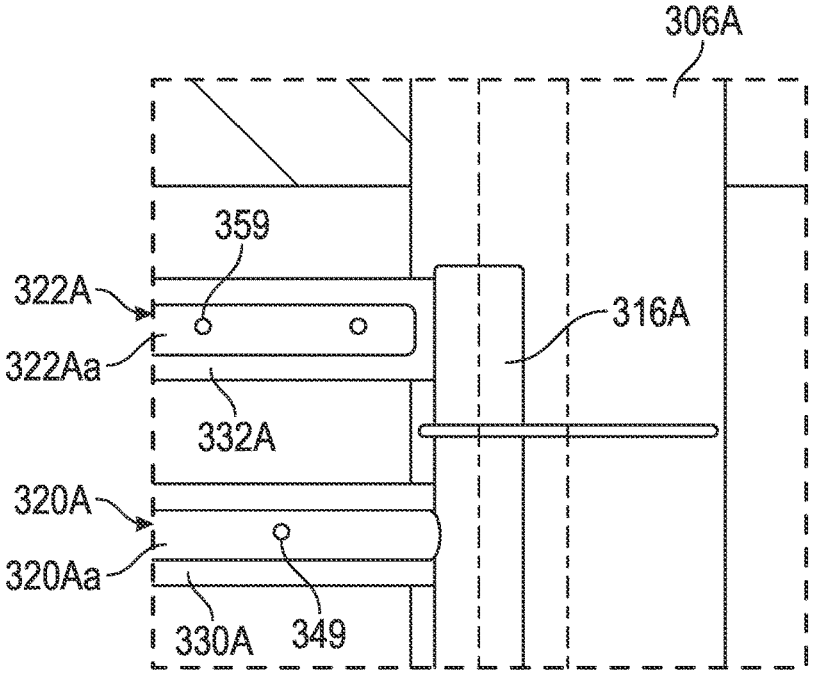
FIG. 8 is a close-up view of a portion of the distribution grid of FIG. 4 showing a supported distribution branch and an unsupported distribution branch.

As can be seen in FIG. 7, each of first distribution branches 320A can be located adjacent one of mixing baffles 330A. As can be seen in FIG. 7, each of second distribution branches 322A can be located adjacent one of mixing baffles 332A. Note that mixing baffles 330A and mixing baffles 332A are omitted from FIG. 3A, FIG. 3B, FIG. 4 and FIG. 5 for clarity. As can be seen in FIG. 8, each of first distribution branches 320A can include a plurality of openings 349. As can be seen in FIG. 8, each of second distribution branches 322A can include a plurality of openings 359. As discussed below, plurality of openings 349 and plurality of openings 359 can cooperate with mixing baffles 330A and mixing baffles 332A to introduce turbulence into exhaust duct 302 (FIG. 3A) to promote mixing.

Figure 6:
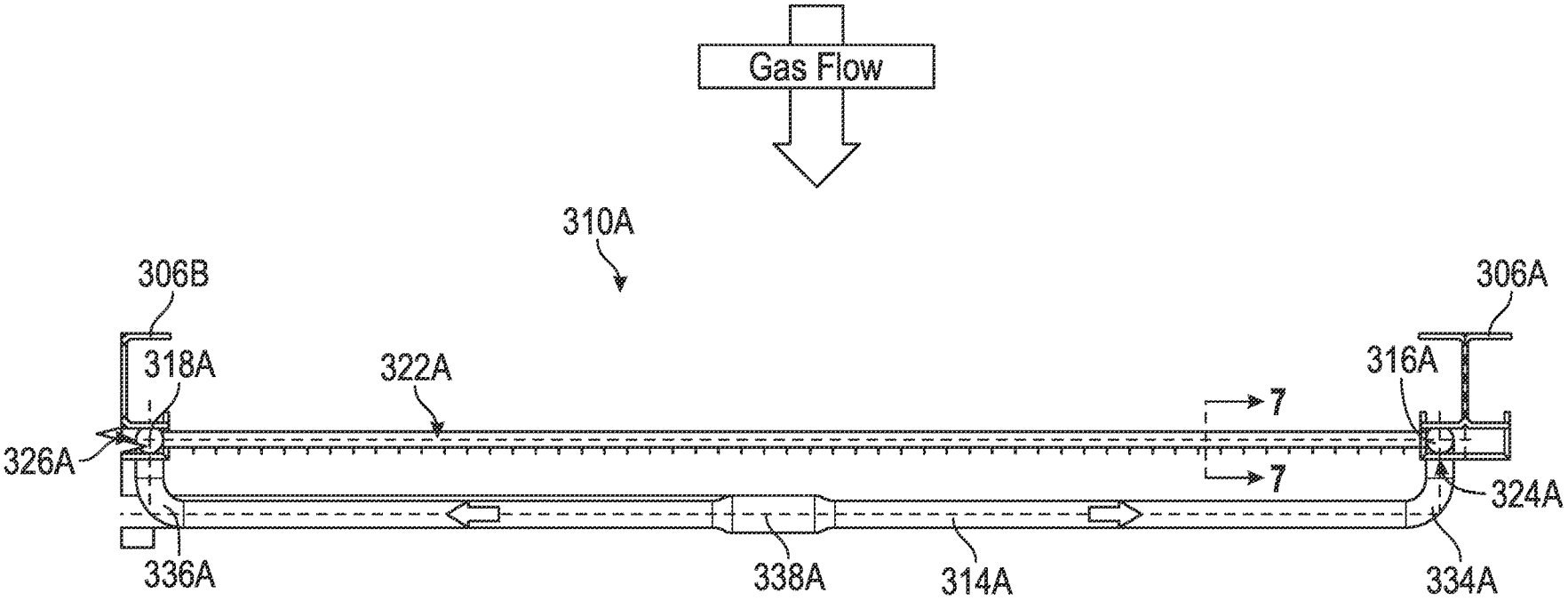
FIG. 6 is a top view of the injection grid of FIG. 4 showing a header, manifolds, a distribution branch and a mixing baffles for the distribution grid.

FIG. 6 is a top view of first injection grid 310A of injection system 300 of FIG. 3B showing header 314A connected to first manifold 316A and second manifold 318A. Second distribution branches 322A can extend from second manifold 318A. First distribution branches 320A (FIG. 3B) can extend from first distribution manifold 36A, but are covered by second distribution branches 322A in FIG. 6. Mixing baffles 332A (FIG. 7) are shown adjacent second distribution branches 322A. Mixing baffles 330A (FIG. 7/FIG. 8) extend behind first distribution branches 320A (FIG. 4), but are covered by mixing baffles 332A in FIG. 6. FIG. 6 and other drawings herein illustrate header 314A being downstream of first distribution branches 320A and second distribution branches 322A. However, header 314A and the other headers described herein can be located upstream of first distribution branches 320A and second distribution branches 322A in other configurations.

First distribution branches 320A can extend from first manifold 316A along axes A1, as shown in FIG. 5. Each axis A1 can extend in a common plane. As such, first distribution branches 320A can extend directly from first manifold 316A in a perpendicular manner. Thus, first distribution branches 320A can be welded directly to first manifold 316A. During operation, reductant can flow from first manifold 316A along a trajectory of axes A1 with a gradient having diminishing or lowering mass flow.

Second distribution branches 322A can extend from second manifold 318A along axes A2, as shown in FIG. 5. Each axis A2 can extend in a common plane. As such, second distribution branches 322A can extend directly from second manifold 318A in a perpendicular manner. Thus, second distribution branches 322A can be welded directly to first manifold 318A. During operation, reductant can flow from second manifold 318A along a trajectory of axes A2 with a gradient having diminishing or lowering mass flow.

As can be seen in FIG. 6, the plane of axes A1 and the plane of axes A2 can be the same or can be coexistent, e.g., co-planar. First manifold 316A and second manifold 318A can be located within the same plane. First distribution branches 320A and second distribution branches 322A can be in the same plane, e.g., can be within planes that are coexistent, as first manifold 316A and second manifold 318A. Header 314A can extend out of such plane via elbow connector 334A and elbow connector 336A. First supply pipe 312A can extend in the same plane as header 314A by T-joint 338A.

FIG. 7 is schematic side cross-sectional view of first distribution branch 320Aa and first distribution branch 320Ab of first section 324A interleaved with second distribution branch 322Aa and second distribution branch 322Ab of second section 326A. Each of first distribution branch 320Aa, first distribution branch 320Ab, second distribution branch 322Aa and second distribution branch 322Ab are located adjacent one of mixing baffles 330A and mixing baffles 332A.

Injection system 300 can be positioned within exhaust duct 302 so that exhaust gas flows against and over mixing baffles 330A and mixing baffles 332A before flowing across first distribution branches 320A and second distribution branches 322A. Mixing baffles 330A and mixing baffles 332A can extend along the lengths of first distribution branches 320A and second distribution branches 322A, respectively. Mixing baffles 330A and mixing baffles 332A can be configured to generate turbulence within the flow of exhaust gas to promote mixing of the reductant and the exhaust gas. The mixing baffles can include perforation to allow some flow of exhaust gas therethrough. In examples, mixing baffles 330A can be welded to first distribution branches 320A and mixing baffles 332A can be welded to second distribution branches 322A.

FIG. 8 is a close-up view of a connected end of first distribution branch 320Aa fluidly coupled to first manifold 316A and a free end of second distribution branch 322Aa fluidly uncoupled from first manifold 316A.

The closed ends of first distribution branches 320A and second distribution branches 322A can be supported by their opposing manifold without forming a fluid connection thereto. For example, as can be seen in FIG. 8, the closed end of second distribution branch 322Aa can be spaced from first manifold 316A, thereby preventing reductant flow from one to the other. However, the closed ends of second distribution branches 322A can be mechanically connected to first manifold 316A to provide support to second distribution branches 322A. For example, couplers 340A and couplers 342A of FIG. 3B can be used. Any suitable mechanical connection can be provided, such as by welding, fasteners or straps. Appropriate brackets or flanges extending from first manifold 316A and/or first support column 306A can also be used to support second distribution branches 322A, for example.

In various designs of the present disclosure, there are no attempts to reduce the distribution gradient of reactant in a single distribution branch. Instead, openings (e.g., plurality of openings 349 of FIG. 8) within first distribution branches 320A and openings (e.g., plurality of openings 359 of FIG. 8) within second distribution branches 322A are located in such a manner as to counter-balance their respective distribution gradients. The sizes and shapes of each of plurality of openings 349 and plurality of openings 359 can be the same or uniform to facilitate equal or similar flow patterns when interleaved such that the distribution gradients are superposed.

In examples, the output from one of plurality of openings 349 (FIG. 8) of first distribution branch 320Aa located closest to first manifold 316A can comprise a "high output" opening that receives relatively cool, high density, high pressure reductant, and the output from one of plurality of openings 359 (FIG. 8) of second distribution branch 322Aa located closest to first manifold 316A can comprise a "low output" opening that receives relatively warm, low density, low pressure reductant. Thus, the output of plurality of openings 359 will be counter-balanced by the output from a nearby opening of plurality of openings 349.

It is expected that the counter-balancing of the various distribution gradients of reductant along first distribution branches 320A that are adjacent and interleaved with second distribution branches 322A will result in an improved, nearly uniform distribution of reductant at the catalyst surface, e.g., the surface of SCR catalyst 160 of FIG. 2, thereby improving and enhancing the emissions control effectiveness and efficiency of the SCR system 154.

Additionally, the central feed point formed by header 314A, for example, can further enhance homogeneity of the temperature of the reductant. The central feed point can utilize a common feed location to feed both of the right supply manifold (e.g., first manifold 316A) and left supply manifold (e.g., first manifold 318A) of each distribution array, e.g., first section 324A and second section 326A. For example, reductant from first supply pipe 312A can flow into a central portion or a middle, e.g., equidistant from first manifold 316A and second manifold 318A, of header 314A thereby forming a central feed point. As such, the manifolds of the present disclosure are centrally connected to supply headers, resulting in the manifolds 316A, 318A feeding the distribution branches from their ends. This design differs from prior art designs involving the use of a manifold positioned at the center of distribution branches. A beneficial effect of the central feed point of the header is to facilitate the temperature of the reductant provided to first manifold 316A and second manifold 318A being approximately the same. Thus, the travel distance and the associated residence time from the point at which a feed pipe, e.g., first supply pipe 312A, enters the SCR inlet duct, e.g., exhaust duct 302, to the central feed point on header 314A and then to the left and right manifolds, e.g., first manifold 316A and first manifold 318A, is approximately equal, resulting in approximately equal temperatures of the reductant within first manifold 316A and second manifold 318A. With reference to FIG. 3A, it will be appreciated that the total travel distance and associated residence time for the distal array, e.g., first injection grid 310A and third injection grid 310C, is slightly greater than the residence time for the proximal arrays, e.g., second injection grid 310B and fourth injection grid 310D. However, such difference is immaterial to ensuring equal flow to the proximal and distal manifolds, e.g., first manifold 316A and second manifold 318A, for each injection zone, e.g., first injection grid 310A, because the reductant flow to each injection zone can be adjusted using flow control valves, e.g., control valve 313A through control valve 313D, in the reductant feed pipe, e.g., first supply pipe 312A, located external to the SCR inlet duct, e.g., exhaust duct 302. Thus, in examples, each injection zone, e.g., first injection grid 310A, second injection grid 310B, third injection grid 310C and fourth injection grid 310D, can have two manifolds. These manifolds can be fed at the center-point of the injection zone via a feed pipe. Flow to each of the feed pipes are controlled via flow control valves which are external to the SCR.

The interleaved design of the present disclosure can accommodate multiple zones in order to provide fine control of reductant flow within the SCR System inlet duct or the SCR reactor. For example, as shown in FIG. 3A, there can be four zones, however any number of zones can be used in order to provide desired reductant flow within the SCR inlet duct, e.g., exhaust duct 302. The interleaved design can enhance uniformity of distribution of reductant at the catalyst, e.g., the surface of SCR catalyst 160 of FIG. 2.

Figure 9:
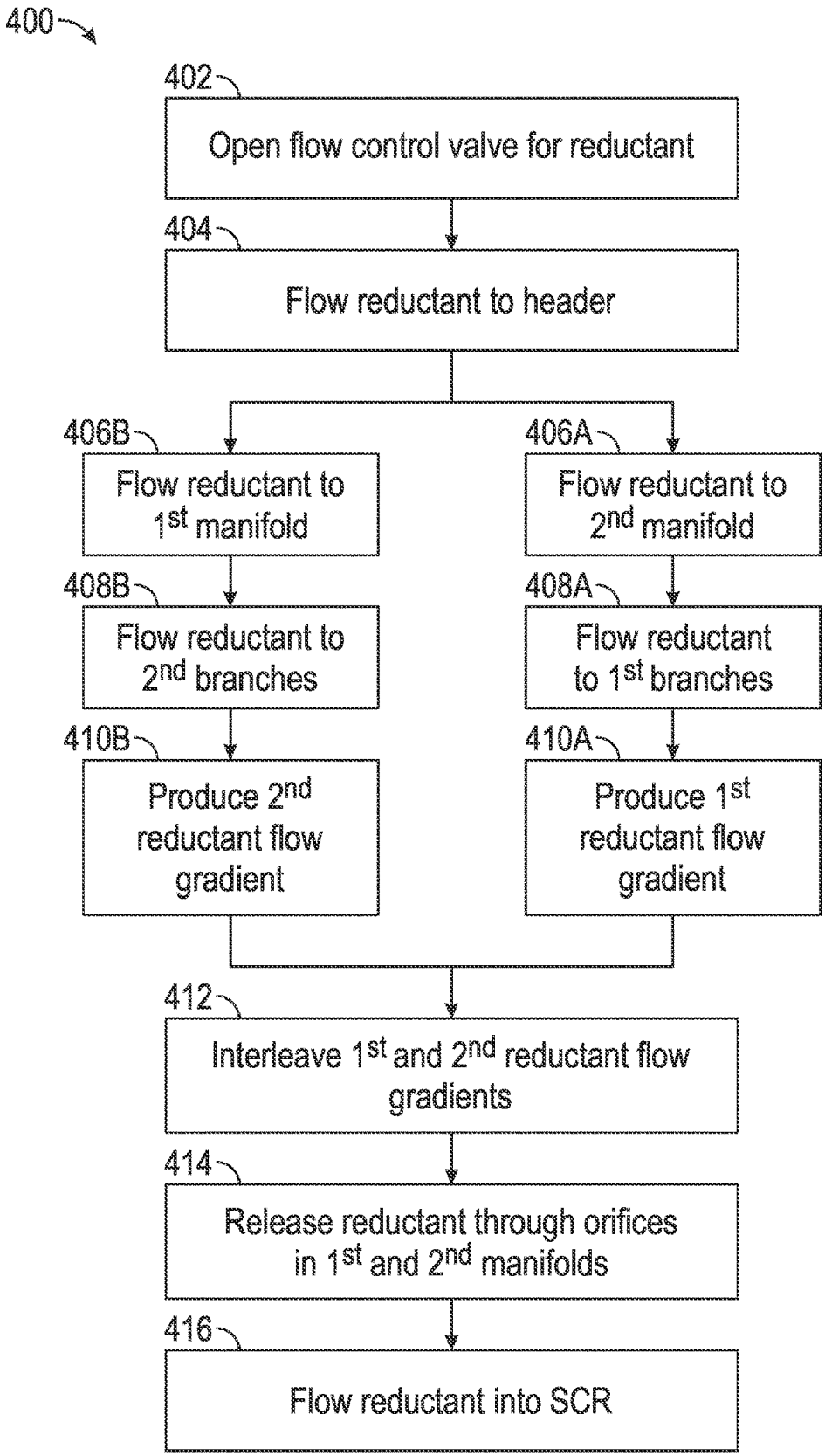
FIG. 9 is a block diagram of a method for injecting reductant into an exhaust duct of an emission reduction system.

FIG. 9 is a block diagram of method 400 for injecting reductant into an exhaust duct of an emission reduction system. Though discussed with reference to power plant 110 and injection system 300, method 400 can encompass the use of any injection system, such as those used in duct burner injection grids, steam injection grids and the like. Method 400 can additionally include fewer or greater operations other than operation 402 to operation 416. Additionally, in other examples, operation 402 through operation 416 can be performed in other sequences.

At operation 402, one or more valves can be opened to allow reductant to flow to a distribution grid of an emissions reduction system. The reductant can flow into a distribution pipe on the exterior of an exhaust duct that enters into the exhaust duct. For example, control valve 313A, control valve 313B, control valve 313C and control valve 313D (FIG. 3A) can be opened to allow reductant to flow into first supply pipe 312A, second supply pipe 312B, third supply pipe 312C and fourth supply pipe 312D. In one embodiment, all of the valves can be opened the same amount, such as by being fully opened, and can remain open during use.

Alternatively, the valves may be opened slightly different amounts to provide differential flow to varying ones of the supply pipes 312A-D. For example, it may be desired to adjust the valves to compensate for manufacturing tolerances of some of the manifolds and/or distribution branches, and thereby optimize the uniformity of conversion of NOx and efficient consumption of reductant.

At operation 404, reductant can flow from the distribution pipe into a header used to distribute reductant within a distribution grid. The header can have ends that extend to different locations within the exhaust duct at different locations on the distribution grid. For example, reductant can flow from first supply pipe 312A, second supply pipe 312B, third supply pipe 312C and fourth supply pipe 312D into headers for first injection grid 310A, second injection grid 310B, third injection grid 310C and fourth injection grid 310D, respectively. First supply pipe 312A, second supply pipe 312B, third supply pipe 312C and fourth supply pipe 312D can be connected to the middle or center of the headers, respectively.

At operation 406A, reductant can flow from the header to a first manifold. At operation 406B, reductant can flow from the header to a second manifold. For example, reductant from header 314A can flow into first manifold 316A and second manifold 318A. The headers can be connected to the middle of center of each manifold. The first manifold and the second manifold can be located in opposing locations, such as at the opposite sides of an exhaust duct or at opposing locations within an exhaust duct.

At operation 408A, reductant can flow from the first manifold to one or more first distribution branches extending from the first manifold. At operation 408B, reductant can flow from the second manifold to one or more second distribution branches extending from the first manifold. For example, reductant can flow from first manifold 316A to first distribution branches 320A and from second manifold 318A to second distribution branches 322A. Reductant within first distribution branches 320A can flow toward second manifold 318A and reductant within second distribution branches 322A can flow toward first manifold 316A.

At operation 410A, reductant can flow through the first distribution branches and, as a result of a temperature gradient and/or a pressure gradient, produce a first reductant distribution gradient. At operation 410B, reductant can flow through the second distribution branches and, as a result of a temperature gradient and/or a pressure gradient, produce a second reductant distribution gradient. The first reductant distribution gradient and the second reductant distribution gradient can comprise decreasing mass flows of reductant due to, for example, flow resistance within the distribution branches and longer residency times of reductant within the distribution branches and a corresponding longer exposure time to heat of the exhaust gas within the exhaust duct.

At operation 412, the first reductant gradient and the second reductant gradient can be superposed with each other. The reductant gradients can be superposed by interleaving the first and second distribution branches of each grid with each other in a common plane. Thus, for example, first distribution branches 320A can be interleaved with second distribution branches 322A in a common plane so that first distribution branches 320A and second distribution branches 322A are arranged in an "every other" or alternating fashion where neighboring distribution branches are from an opposite manifold. Thus, if one of first distribution branches 320A has a neighboring distribution branch above or below it, it will be one of second distribution branches 322A. However, in other examples, first distribution branches 320A can be offset in a different plane as second distribution branches 322A, or first distribution branches 320A can be staggered in different planes and second distribution branches 322A can be staggered in the same manner. The first and second distribution branches can be arranged in a counterflow arrangement where the flows through the distribution branches are in opposite directions. Thus, reductant in first distribution branches 320A can flow toward second manifold 318A and reductant in second distribution branches 322A can flow toward first manifold 316A.

At operation 414, reductant can be released from the first manifold along the length of the first distribution branch and reductant can be released from the second manifold along the length of the second distribution branch. Reductant can pass from first distribution branches 320A through plurality of openings 349 and from second distribution branches 322A through plurality of openings 359. Each of plurality of openings 349 and plurality of openings 359 can be of the same size, e.g., diameter, to allow the superposed distribution gradients to balance and homogenize the delivery of reductant to the SCR catalyst 160. However, in other examples, plurality of openings 349 and plurality of openings 359 can have varying shapes or different shapes.

At operation 416, reductant from the first distribution branch and the second distribution branch can mix with the exhaust gas in the exhaust duct, and can react with NOx in the exhaust gas as it passes through the SCR catalyst 160. Thus, SCR catalyst can facilitate the reaction between NOx and reductant to convert the NOx within the exhaust gas into diatomic nitrogen and water.

The present application describes an emissions reduction system designed for thermal power plants, including coal-fired and gas turbine power plants. The system is useful in improving the distribution of a reducing agent, such as ammonia, within an exhaust duct to reduce emissions more efficiently. In examples, the disclosed distribution systems can be used to inject reductant into an emissions reduction system, but can also be used in inject or introduce other substances or liquids into a power plant, such as a flow of fuel or steam within a duct.

There is a need for gas turbine power plants to have emissions control systems to comply with environmental regulations. Emissions from gas turbines are typically controlled by a carbon monoxide (CO) catalyst system and a selective catalytic reduction (SCR) system, which convert harmful emissions like CO and nitrogen oxides (NOX) into less harmful substances.

The inventor has recognized a problem with conventional distribution systems for reducing agents, which can lead to uneven distribution and inefficient emissions reduction. The proposed solution is a distribution system that uses multiple manifolds with interleaved distribution branches that have counterflow of the reducing agent. This design aims to offset the gradient in mass flow from one manifold with the gradient from another, resulting in a relatively even distribution pattern across the exhaust duct.

The interleaved design of the present disclosure can utilize less welding and lower cost relative to other distribution systems where distribution branches are joined to manifolds at central portions of the distribution branches, which requires out-of-plane connections, such as T-joints, that require multiple welds for each distribution branch. Whereas, with the present disclosure, each distribution branch can be joined in-plane to an end of a manifold with a single weld.

The present disclosure can help reduces reductant waste that can arise from over-injection of reductant to compensate for distribution irregularities or variances.

VARIOUS NOTES & EXAMPLES

Example 1 is a distribution system for injecting reductant into an exhaust duct of a thermal power plant, the distribution system comprising: a first injection grid comprising: a first manifold; and a first plurality of distribution branches extending from the first manifold; and a second injection grid comprising: a second manifold; and a second plurality of distribution branches extending from the second manifold; wherein the first plurality of distribution branches is interleaved with the second plurality of distribution branches, and the first plurality of distribution branches and the second plurality of distribution branches each receive reductant flow from their respective manifold in opposite directions.

In Example 2, the subject matter of Example 1 optionally includes wherein: the first plurality of distribution branches extend from the first manifold in a first plane with the first manifold; the second plurality of distribution branches extend from the second manifold in a second plane with the second manifold; and the first plane and the second plane are coplanar.

In Example 3, the subject matter of any one or more of Examples 1-2 optionally include wherein: first ends of the first plurality of distribution branches are fluidly connected to the first manifold; second ends of the first plurality of distribution branches opposite the first ends are fluidly uncoupled from the second manifold; third ends of the second plurality of distribution branches are fluidly connected to the second manifold; and fourth ends of the second plurality of distribution branches opposite the third ends are fluidly uncoupled from the first manifold.

In Example 4, the subject matter of Example 3 optionally includes wherein: the first plurality of distribution branches extend from the first manifold toward the second manifold, such that the second ends are disposed proximate the second manifold; and the second plurality of distribution branches extend from the second manifold toward the first manifold, such that the fourth ends are disposed proximate the first manifold.

Example 5 is an emissions reduction system for a power plant having an exhaust generator, the emissions reduction system comprising: a duct defining a flow space configured to receive exhaust gas from the exhaust generator; a catalyst panel disposed within the duct; and an injection system configured to inject a reductant into the exhaust gas for reaction with NOx in presence of the catalyst panel, the injection system comprising: a first injection grid configured to inject reductant into the duct along a first axis having a first reductant mass flow gradient; and a second injection grid configured to inject reductant into the duct along a second axis having a second having a second reductant mass flow gradient; wherein the first reductant mass flow gradient and the second reductant mass flow gradient have offsetting trajectories within the duct.

In Example 6, the subject matter of Example 5 optionally includes wherein: the first reductant mass flow gradient decreases along the first axis from a first end to a second end; and the second reductant mass flow gradient decreases along the second axis from a third end to a fourth end; wherein the first end and the fourth end are located proximate each other, and the third end and the second end are located proximate each other.

In Example 7, the subject matter of any one or more of Examples 5-6 optionally include wherein: the first injection grid comprising: a first manifold; and a first distribution branch extending from the first manifold along the first axis from a first end to a second end; and the second injection grid comprising: a second manifold; and a second distribution branch extending from the second manifold along the second axis from a third end to a fourth end.

In Example 8, the subject matter of Example 7 optionally includes wherein the first manifold is located at a first position within the duct and the second manifold is located at a second position within the duct spaced apart from the first position.

In Example 9, the subject matter of any one or more of Examples 7-8 optionally include wherein the first manifold and the second manifold are connected to a header and the header is connected to a common feed pipe at a center of the header.

In Example 10, the subject matter of any one or more of Examples 7-9 optionally include wherein: the first distribution branch and the first manifold extend within a first plane; and the second distribution branch and the second manifold extend within a second plane that is coplanar with the first plane.

In Example 11, the subject matter of Example 10 optionally includes a plurality of first distribution branches extending from the first manifold in the first plane; and a plurality of second distribution branches extending from the second manifold in the second plane.

In Example 12, the subject matter of any one or more of Examples 7-11 optionally include wherein: the first end of the first distribution branch is fluidly connected to the first manifold; the second end of the first distribution branch is mechanically supported at the second manifold; the third end of the second distribution branch is fluidly connected to the second manifold; and the fourth end of the second distribution branch is mechanically supported at the first manifold.

In Example 13, the subject matter of any one or more of Examples 7-12 optionally include a first baffle extending along the first distribution branch; and a second baffle extending along the second distribution branch.

In Example 14, the subject matter of any one or more of Examples 7-13 optionally include wherein the first injection grid and the second injection grid are two of a plurality of injection grids disposed within the duct to provide coverage for a portion of a cross-sectional area of the duct.

In Example 15, the subject matter of any one or more of Examples 5-14 optionally include a system for supplying reductant into the injection system, the reductant comprising anhydrous ammonia, aqueous ammonia or urea; wherein the catalyst panel comprises a NOx catalyst panel.

Example 16 is a method for injecting a reductant into an exhaust duct of a power plant, the method comprising: generating a first mass flow gradient of reductant along a first axis, wherein the first mass flow gradient decreases in a first direction along the first axis; generating a second mass flow gradient of reductant along a second axis, wherein the second mass flow gradient decreases in a second direction along the second axis; wherein the first direction and the second direction are disposed in a counterflow arrangement; releasing reductant of the first mass flow gradient into the exhaust duct; and releasing reductant of the second mass flow gradient into the exhaust duct.

In Example 17, the subject matter of Example 16 optionally includes wherein: generating a first mass flow gradient of reductant along a first axis comprises: flowing reductant into a first manifold; and flowing reductant from the first manifold to a first distribution branch extending along the first axis; and generating a second mass flow gradient of reductant along a second axis comprises: flowing reductant into a second manifold; and flowing reductant from the second manifold to a second distribution branch extending along the second axis.

In Example 18, the subject matter of Example 17 optionally includes flowing reductant into a header at a middle point of the header; and flowing reductant from the header into a middle point of the first manifold and a middle point of the second manifold.

In Example 19, the subject matter of any one or more of Examples 17-18 optionally include flowing reductant through the first distribution branch in a first direction; and flowing reductant through the second distribution branch in a second direction counter to the first direction.

In Example 20, the subject matter of any one or more of Examples 17-19 optionally include wherein generating the first mass flow gradient and the second mass flow gradient comprise: increasing residency time of reductant within the first distribution branch along the first axis and increasing residency time of reductant with the second distribution branch along the second axis; and flowing exhaust gas over the first distribution branch and the second distribution branch.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72 (b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A method for injecting a reductant into an exhaust duct of a power plant, the method comprising:

flowing the reductant into a first manifold, wherein the first manifold extends from a first end to a second end along a first axis;

flowing the reductant into a second manifold, wherein the second manifold extends from a third end to a fourth end along a second axis;

wherein the first manifold and the second manifold define a boundary having a length defined by lengths of the first manifold and the second manifold and a width defined by a distance between the first manifold and the second manifold;

generating a first mass flow gradient of the reductant along a third axis extending from the first manifold along the width, wherein the first mass flow gradient decreases in a first direction along the third axis;

generating a second mass flow gradient of the reductant along a fourth axis extending from the second manifold along the width, wherein the second mass flow gradient decreases in a second direction along the fourth axis;

wherein the first mass flow gradient along the third axis and the second mass flow gradient along the fourth axis are disposed in a counterflow arrangement;

releasing the reductant of the first mass flow gradient into the exhaust duct;

releasing the reductant of the second mass flow gradient into the exhaust duct; and combining the reductant of the first mass flow gradient and the second mass flow gradient within the exhaust duct to produce a nearly uniform flow of the reductant within the boundary.

2. The method of claim 1, wherein:

generating the first mass flow gradient of the reductant along the third axis comprises:

flowing the reductant into the first manifold; and flowing the reductant from the first manifold to a first distribution branch extending along the third axis; and generating the second mass flow gradient of the reductant along the fourth axis comprises:

flowing the reductant into the second manifold; and flowing the reductant from the second manifold to a second distribution branch extending along the fourth axis.

3. The method of claim 2, further comprising:

flowing the reductant into a header at an entrance located at a middle point of the header; and flowing the reductant from the header into an entrance of the first manifold at a middle point of the first manifold and into an entrance of the second manifold at a middle point of the second manifold.

4. The method of claim 2, further comprising:

flowing the reductant through the first distribution branch in the first direction; and flowing the reductant through the second distribution branch in the second direction, the second direction being counter to the first direction.

5. The method of claim 2, wherein generating the first mass flow gradient and the second mass flow gradient comprise:

increasing residency time of reductant within the first distribution branch along the third axis and increasing residency time of reductant with the second distribution branch along the fourth axis; and flowing exhaust gas over the first distribution branch and the second distribution branch.

6. The method of claim 1, further comprising flowing exhaust gas from a gas turbine engine through the exhaust duct to mix with the reductant.

7. The method of claim 6, further comprising:

disrupting flow of the exhaust gas in front of the first mass flow gradient with a first deflector; and disrupting flow of the exhaust gas in front of the second mass flow gradient with a second deflector.

8. The method of claim 1, wherein:

the first mass flow gradient comprises one of a plurality of first mass flow gradients extending along axes parallel to the third axis; and the second mass flow gradient comprises one of a plurality of second mass flow gradients extending along axes parallel to the fourth axis.

9. The method of claim 8, wherein first mass flows of the plurality of first mass flow gradients are interleaved with second mass flows of the plurality of second mass flow gradients.

10. The method of claim 1, wherein:

generating the first mass flow gradient of the reductant along the third axis, wherein the first mass flow gradient decreases in the first direction along the third axis comprises generating a flow of the reductant laterally across the exhaust duct; and generating the second mass flow gradient of the reductant along the fourth axis, wherein the second mass flow gradient decreases in the second direction along the fourth axis comprises generating a flow of the reductant laterally across the exhaust duct.

11. The method of claim 10, wherein:

releasing the reductant of the first mass flow gradient into the exhaust duct comprises releasing the reductant axially through the exhaust duct; and releasing the reductant of the second mass flow gradient into the exhaust duct comprises releasing the reductant axially through the exhaust duct.

12. The method of claim 1, wherein:

the first mass flow gradient extends from the first manifold across the width of the boundary;

the second mass flow gradient extends from the second manifold across the width of the boundary; and the reductant released from the first mass flow gradient into the exhaust duct and the reductant released from the second mass flow gradient into the exhaust duct cancel each other out to form a mass flow of reductant without a gradient between the first manifold and the second manifold.

13. The method of claim 2, wherein:

the first distribution branch includes a first plurality of openings for releasing the reductant;

the second distribution branch includes a second plurality of openings for releasing the reductant; and each of the first plurality of openings is paired with one of the second plurality of openings.

14. The method of claim 3, wherein:

the header has closed ends on opposite ends of the entrance of the header;

the first manifold has closed ends on opposite sides of the entrance of the first manifold; and the second manifold has closed ends on opposite sides of the entrance of the second manifold.

15. The method of claim 3, wherein:

the first manifold is uncoupled and distinct from the second manifold; and the first manifold and the second manifold are located on opposite sides of the length of the boundary at opposite ends of the header.

16. A method for injecting a reductant into a zone of an exhaust duct of a power plant, the method comprising:

generating a first plurality of mass flow gradients of the reductant along a first plurality of axes, wherein:

each of the first plurality of axes extends longitudinally from a first boundary of the zone to a second boundary of the zone;

each of the first plurality of axes is laterally spaced apart between a third boundary of the zone and a fourth boundary of the zone; and each of the first plurality of mass flow gradients decreases in a first direction extending from the first boundary to the second boundary;

generating a second plurality of mass flow gradients of the reductant along a second plurality of axes, wherein:

each of the second plurality of axes extends longitudinally from the second boundary of the zone to the first boundary of the zone;

each of the second plurality of axes is laterally spaced apart between the third boundary of the zone and the fourth boundary of the zone to be interleaved with the first plurality of axes; and each of the second plurality of mass flow gradients decreases in a second direction extending from second boundary to the first boundary;

releasing reductant of the first plurality of mass flow gradients into the exhaust duct; and releasing reductant of the second plurality of mass flow gradients into the exhaust duct;

wherein the first plurality of mass flow gradients and the second plurality of mass flow gradients provide the zone with an even distribution of the reductant.

17. The method of claim 16, wherein:

each of the first plurality of mass flow gradients extends along one of a plurality of first distribution branches;

each of the second plurality of mass flow gradients extends along one of a plurality of second distribution branches; and the plurality of first distribution branches and the plurality of second distribution branches are interleaved with each other along substantially their entire lengths.

18. The method of claim 17, wherein the zone comprises:

a first manifold feeding the plurality of first distribution branches along the first boundary;

a second manifold feeding the plurality of second distribution branches along the second boundary; and a common inlet feeding the first manifold and the second manifold.

19. The method of claim 16, wherein the first boundary and the second boundary comprise parallel lines and the third boundary and the fourth boundary comprise parallel liens such that the zone forms a rectangle.

20. A method for injecting a reductant into a zone of an exhaust duct of a power plant, the method comprising:

flowing the reductant to an inlet of the zone;

flowing the reductant from the inlet into a first manifold positioned on a first side of the zone;

flowing the reductant from the inlet into a second manifold positioned on a second side of the zone;

generating a first mass flow gradient of the reductant along a first distribution branch extending from the first side to the second side, wherein the first mass flow gradient decreases in a first direction along from the first manifold;

generating a second mass flow gradient of the reductant along a second distribution branch extending from the second side to the first side, wherein the second mass flow gradient decreases in a second direction from the second manifold;

wherein the first mass flow gradient and the second mass flow gradient are disposed in a counterflow arrangement and are adjacent each other in the zone;

releasing reductant of the first mass flow gradient into the exhaust duct; and releasing reductant of the second mass flow gradient into the exhaust duct;

wherein residency times of reductant from the inlet to formation of the first mass flow gradient and from the inlet to formation of the second mass flow gradient are substantially equal.

21. The method of claim 20, further comprising mixing reductant of the first mass flow gradient and the second mass flow gradient within the exhaust duct to produce a nearly uniform flow of reductant.

* * * * *